US007922209B1

(12) United States Patent
Beretta

(10) Patent No.: US 7,922,209 B1
(45) Date of Patent: Apr. 12, 2011

(54) METAMERISM-BASED SECURITY PATTERNS

(75) Inventor: Giordano Bruno Beretta, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 702 days.

(21) Appl. No.: 11/615,189

(22) Filed: Dec. 22, 2006

(51) Int. Cl.
*B42D 15/00* (2006.01)
*B42D 15/10* (2006.01)

(52) U.S. Cl. ..... 283/91; 283/72; 283/74; 283/94; 283/99; 283/107; 283/109; 283/901

(58) Field of Classification Search ..... 235/380, 235/488, 492, 494; 283/74, 94, 107, 17, 283/65, 72, 73, 85, 91, 93, 99, 109, 901, 283/903; 428/195.1, 201, 209, 411.1, 457; *B32B 3/00; B42D 15/00; G06K 5/00, 19/02, G06K 19/06*

See application file for complete search history.

(56) References Cited

U.S. PATENT DOCUMENTS

| | | | | |
|---|---|---|---|---|
| 1,612,791 | A | 1/1927 | Ames | |
| 3,752,073 | A | 8/1973 | Lorber | |
| 4,820,163 | A | 4/1989 | McCarty | |
| 5,473,439 | A | 12/1995 | Pappas | |
| 5,670,005 | A | 9/1997 | Look | |
| 5,995,638 | A | 11/1999 | Amidror | |
| 6,198,545 | B1 | 3/2001 | Ostromoukhov | |
| 6,249,588 | B1 | 6/2001 | Amidror | |
| 6,467,810 | B2 * | 10/2002 | Taylor et al. | 283/72 |
| 6,819,775 | B2 | 11/2004 | Amidror | |
| 7,090,913 | B2 * | 8/2006 | Bourdelais et al. | 428/195.1 |
| 7,180,524 | B1 | 2/2007 | Axelrod | |
| 7,246,754 | B2 * | 7/2007 | Siuta et al. | 283/72 |
| 2002/0030360 | A1 | 3/2002 | Herrmann | |
| 2003/0021437 | A1 | 1/2003 | Hersch | |
| 2003/0026500 | A1 | 2/2003 | Hersch | |
| 2003/0043424 | A1 | 3/2003 | Bhaskar | |
| 2003/0161017 | A1 | 8/2003 | Hudson | |
| 2004/0076310 | A1 | 4/2004 | Hersch | |
| 2004/0233463 | A1 | 11/2004 | Hersch | |
| 2005/0052705 | A1 | 3/2005 | Hersch | |
| 2005/0067497 | A1 * | 3/2005 | Jones et al. | 235/492 |
| 2007/0110271 | A1 | 5/2007 | Beretta | |
| 2009/0027415 | A1 | 1/2009 | Dispoto | |

FOREIGN PATENT DOCUMENTS

| | | |
|---|---|---|
| EP | 1073257 | 1/2001 |
| FR | 2838201 | 10/2003 |

OTHER PUBLICATIONS

Wyszecki and Stiles, Color Science: Concepts and Methods, Quantitative Data and Formula, 2nd ed. New York: Wiley, 1982, pp. 183-221.

Teufel et al., Chromatic induction in humans: how are the cone signals combined to provide opponent processing?, Vision Research 44, 2004, pp. 2425-2435.

U.S. Appl. No. 11/017,012, Giordano Beretta.

Rudaz et al., "Protecting identity documents with a just noticeable microstructure," SPIE vol. 4677, pp. 101-109 (2002).

Josef Albers, "Interaction of Color," ISBN 0-300-01846-0, (6 pages) (1971).

(Continued)

*Primary Examiner* — Dana Ross
*Assistant Examiner* — Justin V Lewis

(57) ABSTRACT

An article bears an HVS-perceivable security pattern based on metamerism. The metamerism causes the security pattern to be perceived differently when viewed under two different light sources.

14 Claims, 5 Drawing Sheets

OTHER PUBLICATIONS

Hope et al., "The color compendium," ISBN 0-442-31845-6, pp. 273-274 (1990).
Rolf G. Kuehni, "Color, an introduction to practice and principles," ISBN 0-471-14566-1, (6 pages) (1997) .
Colorcube: "Simultaneous Contrast, Induction" retrieved from www.colorcube.com/illusions/scindctn.htm; Jun. 18, 2007 (1 page).
U.S. Appl. No. 11/280,897, Non-Final Rejection dated Jun. 27, 2008, pp. 1-8 and attachments.
U.S. Appl. No. 11/280,897, Final Rejection dated Jan. 21, 2009, pp. 1-8 and attachments.
U.S. Appl. No. 11/280,897, Non-Final Rejection dated Oct. 5, 2009, pp. 1-10 and attachments.
U.S. Appl. No. 11/280,897, Final Rejection dated Apr. 7, 2010 (12 pages).
U.S. Appl. No. 11/280,897, Examiner's Answer dated Oct. 8, 2010 (15 pages).

* cited by examiner

METAMERISM-BASED SECURITY PATTERNS

BACKGROUND

Counterfeiting poses a serious problem to the pharmaceutical, cosmetics, electronics, software, automotive and aircraft industries, to name a few. Counterfeit products can lead to lost revenues, increased liability, and brand erosion. Product recalls due to counterfeit warnings can be expensive and disruptive.

Overt measures to deter counterfeiting include marking products with distinct colors and patterns, holograms, recto/verso registration, and visible watermarks. Covert measures include marking products with invisible marks and machine readable code, fluorescent and magnetic inks, hidden patterns, encrypted codes, radio frequency identification, engravements, and micro-displacement of glyphs.

Most of these measures add complexity or cost (or both) to product manufacture. In addition, detection can be difficult and slow. Detection using some of these measures involves specialized equipment.

An inexpensive anti-counterfeiting measure is desirable.

In certain situations, quick detection is essential. An inspector might have to enter a store and determine whether the goods being sold are counterfeit. If the inspector draws attention, his life could be at risk.

SUMMARY

According to one aspect of the present invention, an article bears an HVS-perceivable security pattern based on metamerism. The metamerism causes the security pattern to be perceived differently when viewed under two different light sources.

According to another aspect of the present invention, a metamerism-based security pattern is viewed under one light source and then under a different light source. If the security pattern appears the same under both light sources, counterfeiting is suspected.

Other aspects and advantages of the present invention will become apparent from the following detailed description, taken in conjunction with the accompanying drawings, illustrating by way of example the principles of the present invention.

DETAILED DESCRIPTION

Figure 1:
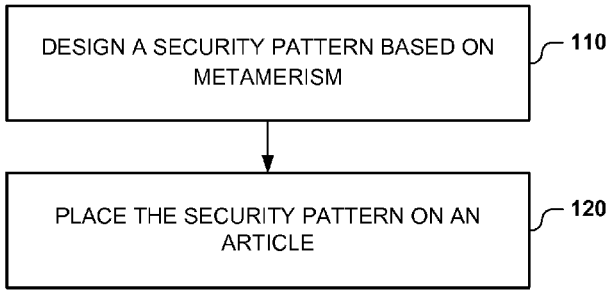
FIG. 1 is an illustration of a method of protecting an object against counterfeiting in accordance with an embodiment of the present invention.

As shown in the drawings for purposes of illustration, the present invention is embodied in security patterns based on metamerism. Metamerism refers to a property in which spectrally different color stimuli have the same tristimulus values. Metamerism occurs when two different points map into the same point in a three-dimensional hyperplane. A CIE metamerism index for change in illuminant may be defined as follows. The degree of metamerism M of two specimens that match in color under a given illuminant for a given reference observer is measured in terms of the color difference $\Delta E$ observed between the two specimens but under a different illuminant. For two specimens whose corresponding tristimulus values ($X_1=X_2$, $Y_1=Y_2$, $Z_1=Z_2$) are identical with respect to a reference illuminant and reference observer, the metamerism $M_t$ index is set equal to the index of the color difference $\Delta E$ between the two specimens computed for test illuminant t. A detailed discussion of metamerism can be found in Wyszecki and Stiles, *Color Science: Concepts and Methods, Quantitative Data and Formula,* $2^{nd}$ ed. New York: Wiley, 1982, pp. 183-221.

Metamerism-based security according to the present invention may include the use of metamers or paramers. Metamers are specimens having different spectral curves that produce exactly the same color sensation under the same illuminating and viewing conditions. Paramers are specimens having different spectral curves that produce approximately the same color sensation under the same illuminating and viewing conditions.

Reference is made to FIG. 1, which illustrates a method of protecting an object against counterfeiting. The object is not limited to any particular type. The object could be a pharmaceutical or cosmetic product, an electronics component, software, an automotive or aircraft part, etc.

The method includes designing a security pattern based on metamerism (block 110). The security pattern is perceivable by the human visual system (HVS), but the metamerism causes the security pattern to be perceived differently by the human visual system when the pattern is viewed under two different light sources. The security pattern may stand alone, or it may be integrated into a larger image. For example, the security pattern may be a logo, colored text on a colored background, or an ornamental pattern having two or more colors. Since metamerism can be extended to more than two stimuli, the security pattern may use multiple metamers or paramers. For the purposes herein, achromatic colors white, gray and black are considered to be colors. Several examples of metamerism-based security patterns are provided below.

The method further includes placing the security pattern on an article (block 120). For purposes herein, an article refers to the object being protected against counterfeiting, or the print medium associated with the object to be protected. Examples of the print medium include, without limitation, a package, box, crate, shipping container, pallet, substrate, wrapper, label, test strip, or package insert for the object to be protected. More than one metamerism-based security pattern may be placed on an article.

As a first example, a security pattern may be printed on the surface of an object such as a pill. As a second example, a security pattern may be printed on a textile item (e.g., a scarf, a bag). As a third example, a security pattern may be printed on a box for the object to be protected.

A metamerism-based security pattern may be placed on an article by a printing device that supports the use of metameric inks. Standard inks (e.g., CMYK) or custom color inks (e.g., red, orange, green, blue, violet) may be used. The printing device could be an inkjet printer, a digital printing press, a laserjet printer, a digital plotter, or any other digital device having a print engine. A printing device such as a mechanical printing press may even be used.

Other conventional security measures may be used to further enhance security. Examples of conventional measures include, without limitation, lot numbers, color coding, encoded bar codes, registration or placement encoding, microtext, distinct patterns, character sets, perforations, watermark, guilloches, and seals (e.g., holograms).

Figure 2:
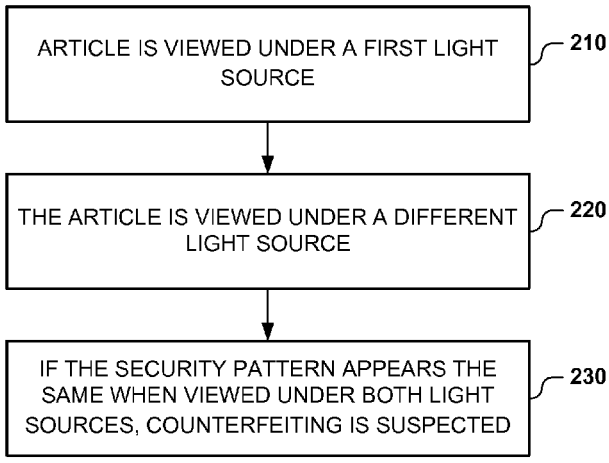
FIG. 2 is an illustration of a method of detecting a counterfeit object in accordance with an embodiment of the present invention.

Reference is made to FIG. 2, which illustrates a method of detecting a counterfeit object. An article is viewed under a first light source (block 210), and then the article is viewed under a second light source (block 220). If the security pattern appears the same when viewed under both light sources, counterfeiting is suspected (block 230). If counterfeiting is suspected, further measures may be taken to determine whether the object is a counterfeit.

Such counterfeiting protection is effective against counterfeiters who simply rely on a visual analysis of the article being counterfeited. Those counterfeiters will probably not detect the use of the metameric colors in the security pattern, and instead will use only a single color in the security pattern.

Such counterfeit protection is inexpensive. The security pattern can be applied during manufacture of the article.

Moreover, such counterfeit detection would allow an inspector to enter a store and quickly determine whether the objects within are counterfeit. If the inspector uses a small (e.g., pen-sized) light source as the second light source, the inspection can be performed without drawing attention.

In a first group of embodiments, metamerism is used to hide a portion of a security pattern. The security pattern uses colors that have different spectral power distributions but match under a reference light source. However, the colors do not match when viewed under a different light source.

In some embodiments of the first group, the security pattern may have a first portion superimposed over a second portion, where the first and second portions use colors having the same appearance under a light source, but have different spectral power curves. In other embodiments of the first group, the first and second portions may be adjacent. In yet other embodiments of the first group, the first and second portions may be spaced apart.

In some embodiments of the first group, one portion may use a spot color, while the other portion uses a process color. A spot color is printed with a single ink of that color. A process color is printed with a dither pattern of two or more fixed inks (e.g., cyan, magenta, yellow, and black). In other embodiments, different portions may use different process colors having the same appearance but have different spectral power curves. In still other embodiments, a single portion may use two colors having the same appearance but different spectral power curves. The security pattern may have additional colored portions having the same appearance but different spectral power curves.

Figure 3:
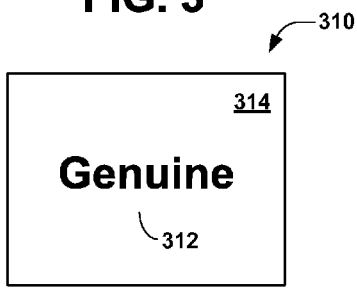
FIG. 3 is an illustration of a security pattern in accordance with an embodiment of the present invention.

Reference is now made to FIG. 3, which provides an example in which metamerism is used to hide a portion of a security pattern 310. The security pattern 310 includes gray text ("Genuine") 312 printed against a gray background 314 (FIG. 3 does not illustrate these grays, instead it illustrates the text 312 in black and the background 314 in white). The text 312 may be printed as a dither pattern of black ink dots, and the background 314 may be printed as a dither pattern of chromatic ink dots. The black ink has a relatively flat reflectance spectrum, while the chromatic inks have relatively peaked reflectance spectra. For example, using a perfectly balanced printer, the gray text can be printed with 40% black, and the background can be printed with 40% each of cyan, magenta, and yellow (CMY), which match when viewed under a reference light source (e.g., a D50 light source). When viewed under a different light source, the same percentages of CMY will not balance the percentage of black, whereby the text will be perceived to have a different color than the background. If that different light source is a tungsten lamp, the radiation emitted by the tungsten lamp will have a larger effect on the process color's magenta and yellow components in the background than the spot color. Consequently, the text will not be readable under the reference light source (daylight) but it will be readable under the tungsten lamp.

The spot color is not limited to an achromatic color. As a first example, text printed with a spot color could be a color such as vivid blue. The background could be printed with a process color balanced with percentages of cyan, magenta and yellow under reference light source (e.g., a $D_{65}$ light source). When viewed under the reference light source, the text will not be readable. When viewed under a different light source, however, the text will be readable.

Consider a different example, where the security pattern includes a first portion adjacent to a second portion. The first portion is printed with a process color such as light yellow. The second portion is printed with a more vivid yellow that is muted by adding a few cyan microdots. These two process colors might appear the same under a tungsten lamp, which has little power in the cyan region of the spectrum. However, the portion with the cyan microdots will appear greener in daylight or a fluorescent lamp, due to the peak reflectance in the cyan area.

The light sources will affect the degree of metamerism. The colors need not be metameric with respect to CIE standard illuminants, but instead can be metameric when viewed under certain unconventional light sources.

Figure 8A:
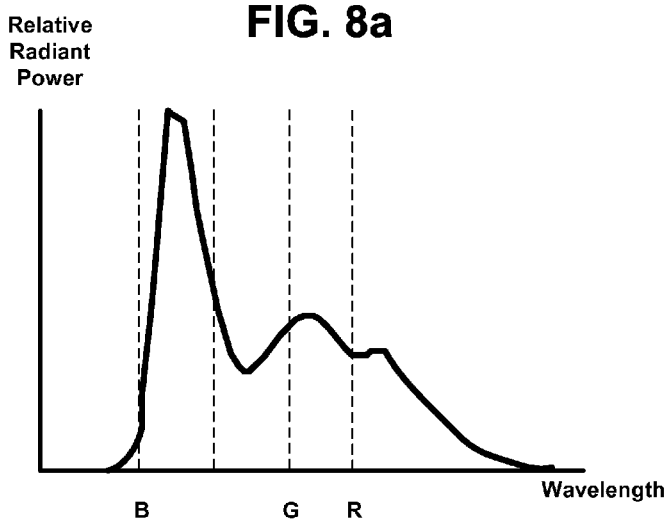
FIG. 8*a* is an illustration of the spectra of an exemplary unconventional light source.
Figure 8B:
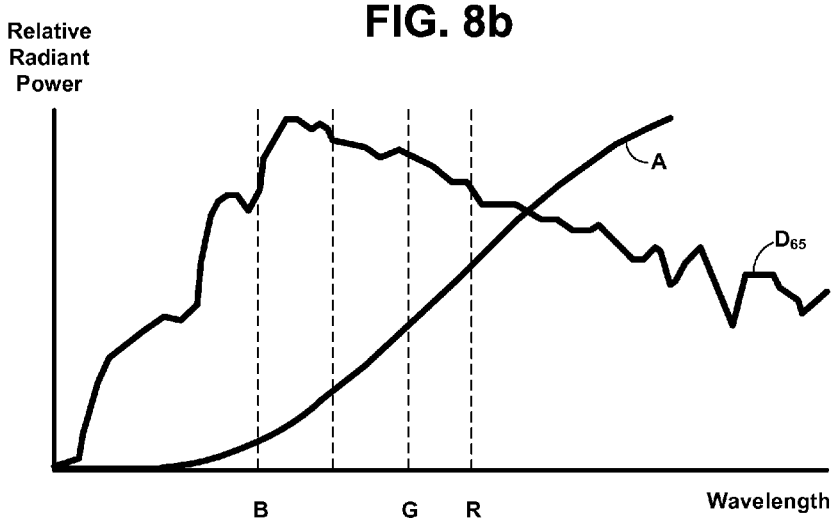
FIG. 8*b* is an illustration of CIE standard illuminants A and $D_{65}$.
Figure 9A:
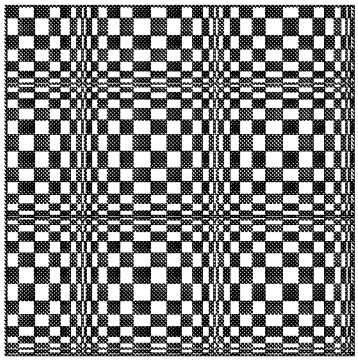
FIGS. 9*a*-9*d* are illustrations of different structures for security patterns in accordance with embodiments of the present invention.
Figure 9B:
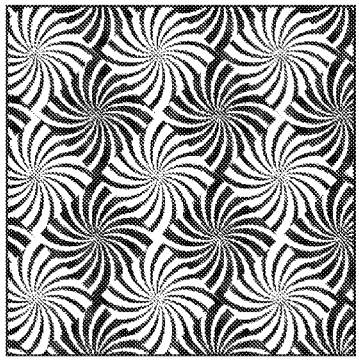
Figure 9C:
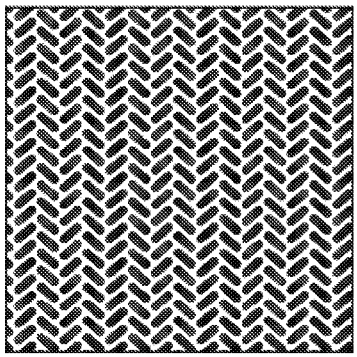
Figure 9D:
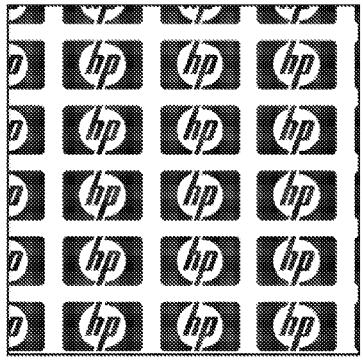

Reference is made to FIGS. 8*a* and 8*b*. An unconventional light source refers to a light source having a peaked spectral curve that is very different than CIE illuminants. Compare the spectra of an exemplary unconventional light source in FIG. 8*a* to standard CIE illuminants A and $D_{65}$ in FIG. 8*b*.

Certain commercially available devices could be used as unconventional light sources. Examples of such devices include, but are not limited to, LCD displays in mobile devices such as mobile phones, digital cameras, PDAs, and laptop computers. Special unconventional light sources can be constructed from LEDs with peaked spectra that collectively emit a white light. For example, a key fob can be constructed with a cap filled with specific narrow band phosphor mixtures.

The use of unconventional light sources can increase the stealthiness of counterfeit detection. An inspector doesn't have to take a product out of its environment (e.g., take it out of a store). The inspector simply uses a seemingly ordinary device to expose the product to unconventional light.

The use of unconventional light sources increases the difficulty of defeating the counterfeit protection. In order to identify the illuminants, the counterfeiter would somehow have to obtain an inspector's light source and analyze it spectrally.

In a second group of embodiments, metamerism is used to hide details of a structure in a security pattern. The structure is printed with vivid colors, which exhibit strong metamerism because their spectra are more peaked. The structure does not create metamerism, only the colors create the metamerism. The details of the structure are HVS-perceivable when viewed under a first light source but not under a second light source. For example, the structure details are HVS-perceivable when viewed under a standard (e.g., $D_{50}$) light source, but not HVS-perceivable when viewed under an unconventional light source. Counterfeit detection can be performed by observing whether the structure details are perceived under both light sources.

The two different light sources are not limited to a conventional light source and an unconventional light source. The two different light sources could be two different conventional light sources, or they could be two different unconventional light sources.

One type of structure is a checkerboard structure made up of two distinct colors that are metameric. The checkerboard structure has its own spectral distribution when its area is averaged. The average is different from the sum of the spectra of the inks because it is a non-linear combination of additive and subtractive effects. When the security pattern is viewed under the standard light source, the two colors do not match, so details (i.e., squares) of the checkerboard structure are perceived. When the security pattern is viewed under an unconventional light source, however, the colors appear to match, so the checkerboard structure details disappear.

The checkerboard structure may be printed with vivid colors that display high metamerism. However, the checkerboard structure is not so limited. Metameric checkerboard structures can be created with inks that by themselves are not metameric.

When used as a frame or matte, a checkerboard structure can create an optical illusion under certain lighting conditions. Counterfeit detection can be performed by observing the optical illusion (or lack thereof) rather than discerning the details of the checkerboard structure. Observing the optical illusion (or lack thereof) can be much faster than examining the structure details.

Figure 4:
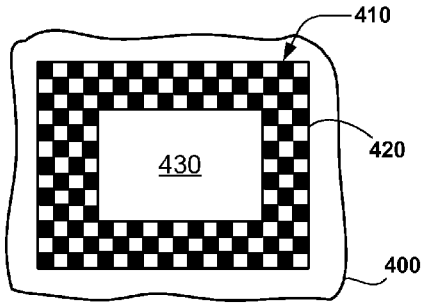
FIG. 4 is an illustration of a security pattern in accordance with an embodiment of the present invention.

Reference is now made to FIG. 4, which illustrates an exemplary security pattern against a background 400. The security pattern 410 includes a frame 420 that surrounds a region 430. The frame 420 has a checkerboard structure. Perceived depth of the region 430 varies as the light sources alternate between a standard light source and an unconventional light source. When viewed under one light source, the details of the checkerboard structure (i.e., the dark and light squares) can't be distinguished, so the frame 420 appears transparent. As a result, the transparent frame 420 elicits a depth perception. When viewed under the other light source, the details of the checkerboard structure are visible and this optical illusion disappears. For example, when viewed under the unconventional light source, the frame 420 appears transparent and hovering about the region 430. The transparent frame 420 changes the perceived depth of the surrounded region 430, i.e., making it appear to pop out or sink with respect of the background 400. However, when viewed under the conventional light source, the details of the frame 430 are clearly visible and the transparency illusion is not present. In the alternative, the checkerboard structure details are not visible under a conventional light source but become visible under an unconventional light source.

Figure 5:
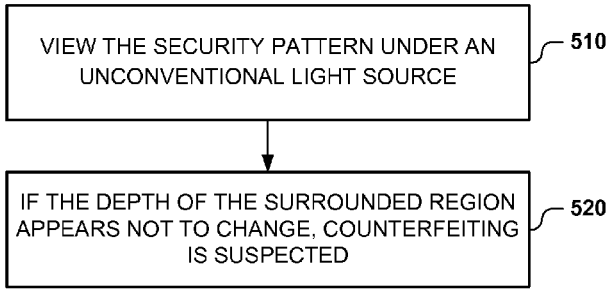
FIG. 5 is an illustration of a counterfeit detection method in accordance with an embodiment of the present invention.

Reference is now made to FIG. 5, which illustrates a counterfeit detection method based on the security pattern illustrated in FIG. 4. The method includes viewing the security pattern under an unconventional light source (block 510). If the depth of the surrounded region appears not to change, counterfeiting is suspected (block 520).

Structures other than the checkerboard structure may be used. Other exemplary structures are illustrated in FIGS. 9*a*-9*d*. Each of these structures is made up of two metameric colors. Although the colors are shows as black and white, they are not so limited. Each of these structures has its own spectral distribution when its area is averaged. The average area of the lighter portion of the structure (e.g., the white squares in the checkerboard structure) is a first non-linear combination of additive and subtractive effects of the spectra of the colors, and average area of the darker portion of the structure (e.g., the black squares in the checkerboard structure) is a second non-linear combination of additive and subtractive effects of the spectra of the colors.

Figure 6:
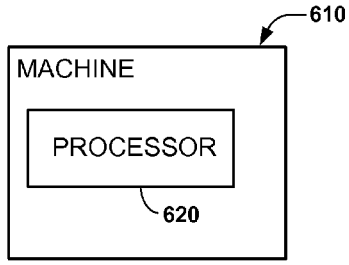
FIG. 6 is an illustration of an apparatus in accordance with an embodiment of the present invention.

Reference is now made to FIG. 6, which illustrates a machine 610 having a processor 620. In some embodiments, the machine 610 may be a digital printing press and the processor 620 may be a front-end processor (a.k.a. RIP, Raster Image Processor or formatter). The front-end processor of the digital printing press can be programmed to add security patterns to the articles. For added security, the front-end processor can be made tamper-proof (e.g., by adding a tamper-proof component that applies the security pattern), so the security patterns cannot be altered.

The digital printing press offers advantages over conventional ink-based printers. The digital printing press can print different content on each copy, which allows customized security patterns to be printed on different articles.

In other embodiments, the machine 610 can be a spooler. A spooler takes a print job from a workstation in one piece and then forwards it piece by piece to a printer as the printer is ready to accept input. The spooler can also perform imaging operations such as simplifying page descriptions. While processing a page to simplify the page description, the spooler can insert a security pattern on the page.

In other embodiments, the machine 610 could be a personal computer or workstation. The computer is used to add security patterns to images that will be printed by an ink-based printer. The computer and conventional ink-based printer could be used for small print runs.

In still other embodiments, the machine 610 could be an ink-based printer that has a built-in module for adding security patterns to articles being printed. The module could be made tamper-proof.

Figure 7:
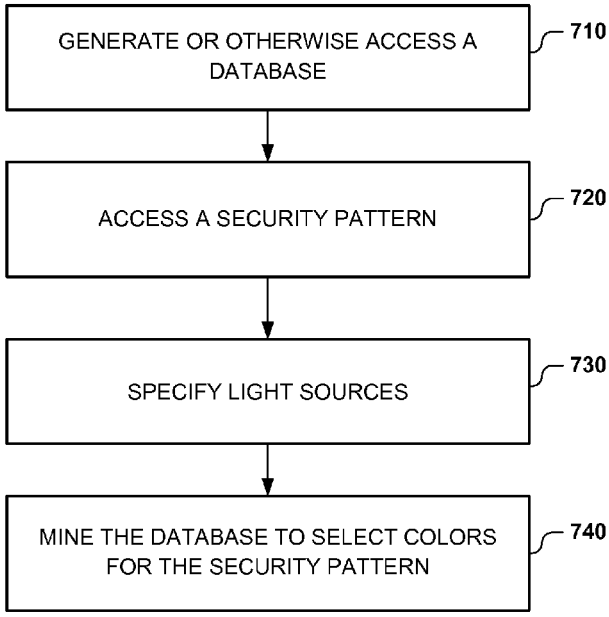
FIG. 7 is an illustration of a method of creating a security pattern in accordance with an embodiment of the present invention.

Reference is now made to FIG. 7, which illustrates a method of generating a security pattern. A database is generated or otherwise accessed (block 710). The database may be generated by printing out patches of different colors, taking spectral measurements of each patch, and creating a database record for each patch. Each record may also consider other factors, such as geometric appearance (e.g., gloss), smoothness of color scales, halftone granularity. The database may contain measurement records for any number of printers and processes.

A security pattern is accessed (block 720). A previously created security pattern could be read from data storage, a security pattern could be created, a security pattern template could be accessed, etc. Colors for the security pattern still have to be selected.

To select the colors for the security pattern, the designer will first specify the light source where the object will be ordinarily located, as well as the light source that will be used for counterfeit detection (block 730). The latter light source might depend in part on how easily the object can be moved to a different light source. For example if the object is located in a store or warehouse, and it can be taken outside, the first light source might be the indoor lighting (e.g., fluorescent) in the store, and the second light source might be outdoor (ambient) lighting. If the object cannot be taken outside, but can be illuminated by a light source that is different than the ambient, the second light source will be that different light source.

The designer might specify unconventional light sources, which do not depend on where the object is located. For example, an inspector might be able to bring two different light sources into a warehouse (e.g., concealed as a pen fob) and expose the security pattern to those two different light source. This approach offers the advantage that the designer doesn't have to know the light source where the object will be located.

The designer will also specify the device that will be used to print the security patterns.

Pairs of colors for the security pattern are selected by mining the database (block 740). A software tool may be used to mine the database. An exemplary software tool compares pairs of measurement records in the database. For each record, the spectral data of the color patch is combined with the spectral data of each of the two light sources to compute the patch's colorimetric appearance under each light source. When a pair of patches has the same color appearance under one light source but a different color appearance under the other light source, a pair of metamers has been found and is added to a list of colors available to the designer to colorize the security mark.

The colors need not match exactly under the first light source. The human visual system's has a certain tolerance for distinguishing colors. The color difference should be below the threshold so the human visual system perceives the same color, even though the colors don't match exactly. Hence the allowance for paramers An exemplary software tool could have a framework that is partitioned into two packages: a package on informatics algorithms and another package on color science algorithms. The informatics package could include algorithms and data structures for optimizing the color science computations.

The color science package may be designed in a layered architecture. A first layer may contain basic colorimetric enumerations, such as CIE illuminants and observers, densitometry standards, and instrument filters; common exceptions (e.g., the specification of a CIE illuminant that has not yet been implemented); psychophysics data standardized by the CIE; and persistent network storage through a database.

A second layer of the color science package may include basic color science concepts such as color term, color lexicon, color atlas, etc. A third layer of the color science package may define color model operators. These operators may be implemented as a hierarchical tree rooted in the generic color operator. These operators can be colorimetric or spectral. Some of the colorimetric operators may include device counts, cone sensitivities, CIE tristimulus, linear and non-linear colorimetric RGB spaces, and CIE based uniform color spaces (UCS, CIELAB).

A fourth layer of the color science package may include metrology models building on the color model operators. The color model operators are essentially color spaces. The metrology models describe the structure of the actual data in these color spaces, on which the color model operators operate. It uses persistent storage to store measurements, metadata and usage structure.

A fifth layer of the color science package may include higher functionalities such as readability of colored text, graphics and images on colored background, and metamerism and database mining. The fifth layer may also offer facilities like finding metamers and finding quadruplets of illuminant and object metamers.

The metamerism computations include applying the color model operators to the measurement records in the database. Then, color matches are determined. The data for the standard illuminants are in the first layer, as are the color matching functions that are used as coefficients for the operations in the third layer, for example the computation of tristimulus values from a spectral distribution. The metrology models in the fourth layer are used to access the spectral data of the ink patches and the unconventional light sources. It may be appreciated that for a sizeable database these computations are quite expensive; therefore, the package with algorithms and data structures is used, providing minimal computation times.

The software tool may be a standalone program or it may be integrated with a larger program (e.g., a graphical editor). The software tool may include a graphical editor for modifying or creating a security pattern.

The invention claimed is:

1. An article bearing a human-perceivable security pattern based on metamerism, wherein the metamerism causes the security pattern to be perceived differently when viewed under two different light sources, wherein the security pattern has a frame surrounding a region, and wherein a perceived depth of the region varies depending upon which of two different light emitted by the two different light sources illuminates the security pattern.

2. The article of claim 1, wherein the security pattern is ink-based.

3. A method of performing counterfeit detection on an article having a security pattern, comprising:

alternating between a first light source and a second, different light source to illuminate the security pattern on the article, wherein the first light source emits first light, and the second light source emits second light, and wherein the first and second light sources are separate from the article; and causing the security pattern to have different perceived appearances when the security pattern is alternately illuminated with the first and second light sources, wherein the security pattern has a frame surrounding a region, and wherein a perceived depth of the region varies depending upon which of the first and second light sources illuminates the security pattern.

4. A method of performing counterfeit detection on an article having a security pattern, comprising:

viewing the article under a first light source that includes a liquid crystal display of a mobile device, and viewing the article under a second, different light source that emits light, wherein counterfeiting is suspected if the security pattern appears the same under both the first and second light sources, wherein the security pattern is based on metamerism that causes a region within a frame of the security pattern to be perceived to have different depths when alternately viewed under the first and second different light sources.

5. Anti-counterfeiting apparatus for printing human-perceivable security patterns on articles, the security patterns based on metamerism, wherein the metamerism causes each security pattern to be perceived differently when viewed under two different external light sources that emit light, wherein the anti-counterfeiting apparatus has a processor to generate the security patterns for printing on the articles, wherein at least one of the security patterns has a frame surrounding a region, wherein a perceived depth of the region varies depending upon which of the two different light sources illuminates the at least one security pattern.

6. The apparatus of claim 5, wherein the apparatus is a digital printing press.

7. The article of claim 1, wherein the frame is perceived as transparent if a first of the two different light sources illuminates the security pattern, and a predetermined pattern of the frame becomes visible if a second of the two different light sources illuminates the security pattern.

8. The article of claim 7, wherein the predetermined pattern is a checkerboard pattern.

9. An article bearing a human-perceivable security pattern based on metamerism, wherein the metamerism causes the security pattern to be perceived differently when viewed under two different light sources, wherein the security pattern is perceived to have a first pattern when the security pattern is illuminated by light emitted by a first of the light sources having a first spectral distribution with a relatively sharp peak in radiant power in a particular wavelength range, and wherein the security pattern is perceived to have a second pattern when the security pattern is illuminated by light from a second of the light sources having a second spectral distribution different from the first spectral distribution, wherein the metamerism is used to hide details of a structure in the security pattern, wherein the structure surrounds a region of the security pattern, and wherein a perceived depth of the surrounded region varies as a light source illuminating the security pattern alternate between the first and second light sources.

10. A method of performing counterfeit detection on an article having a security pattern, comprising:

alternating between a first light source and a second, different light source to illuminate the security pattern on the article; and causing the security pattern to have different perceived appearances when the security pattern is alternately illuminated with the first and second light sources, wherein the security pattern has a frame surrounding a region, and wherein a perceived depth of the region varies depending upon which of the first and second light sources illuminates the security pattern, wherein alternating between the first and second light sources comprises alternating between:

the first light source that emits light having a first spectral distribution with a relatively sharp peak in radiant power in a particular wavelength range, and the second light source that emits light having a second spectral distribution different from the first spectral distribution.

11. The method of claim 3, wherein the frame is perceived as transparent if the first light source illuminates the security pattern, and a predetermined pattern of the frame becomes visible if the second light source illuminates the security pattern.

12. The method of claim 11, wherein the predetermined pattern is a checkerboard pattern.

13. A method of performing counterfeit detection on an article having a security pattern, comprising:

viewing the article under a first light source that includes a liquid crystal display of a mobile device, and viewing the article under a second, different light source, wherein counterfeiting is suspected if the security pattern appears the same under both the first and second light sources, wherein the security pattern is based on metamerism that causes a region within a frame of the security pattern to be perceived to have different depths when alternately viewed under the first and second different light sources, wherein:

the first light source emits light having a first spectral distribution with a relatively sharp peak in radiant power in a particular wavelength range, and the second light source emits light having a second spectral distribution different from the first spectral distribution.

14. The apparatus of claim 5, wherein the frame is perceived as transparent if a first of the two different light sources illuminates the security pattern, and a predetermined pattern of the frame becomes visible if a second of the two different light sources illuminates the security pattern.

* * * * *